US006952596B2

(12) United States Patent
Dearn

(10) Patent No.: US 6,952,596 B2
(45) Date of Patent: Oct. 4, 2005

(54) ACTIVE SUBSCRIBER INFORMATION MODULE

(75) Inventor: Dave Dearn, Wiltshire Snignaeb (DE)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 470 days.

(21) Appl. No.: 10/163,708

(22) Filed: Jun. 6, 2002

(65) Prior Publication Data

US 2004/0204088 A1 Oct. 14, 2004

(30) Foreign Application Priority Data

May 29, 2002 (EP) ..... 02392009

(51) Int. Cl.[7] ..... H04B 1/38; H04M 1/00

(52) U.S. Cl. ..... 455/558; 455/559; 455/575.1; 455/522; 455/445; 455/323

(58) Field of Search ..... 455/558, 559, 455/575.1, 522, 445, 323, 324, 302; 710/8, 102; 235/435, 483, 487

(56) References Cited

U.S. PATENT DOCUMENTS

| | | | | |
|---|---|---|---|---|
| 5,973,980 A | | 10/1999 | Tiede et al. | 365/226 |
| 6,032,055 A | | 2/2000 | Yazaki et al. | 455/558 |
| 6,092,133 A | * | 7/2000 | Erola et al. | 710/301 |
| 6,157,966 A | | 12/2000 | Montgomery et al. | 710/8 |
| 6,178,324 B1 | * | 1/2001 | Choquet et al. | 455/558 |
| 6,263,214 B1 | | 7/2001 | Yazaki et al. | 455/558 |
| 6,324,402 B1 | | 11/2001 | Waugh et al. | 455/445 |
| 6,369,553 B1 | | 4/2002 | Davis | 323/274 |
| 6,463,268 B2 | * | 10/2002 | Tomiyama | 455/302 |
| 6,466,804 B1 | * | 10/2002 | Pecen et al. | 455/558 |
| 6,549,773 B1 | * | 4/2003 | Linden et al. | 455/426.1 |
| 2001/0014595 A1 | * | 8/2001 | Tomiyama | 455/323 |

FOREIGN PATENT DOCUMENTS

| | | | |
|---|---|---|---|
| EP | 0936790 A1 | 8/1999 | H04M/1/274 |
| EP | 1197825 A2 | 4/2002 | G05F/1/46 |

* cited by examiner

*Primary Examiner*—Nick Corsaro
*Assistant Examiner*—Shaima Q. Aminzay
(74) *Attorney, Agent, or Firm*—George O. Saile; Stephen B. Ackerman

(57) ABSTRACT

This invention provides a circuit and a method for interfacing a subscriber information module, SIM to a base band controller for a mobile phone. It provides voltage level shifting to allow a low voltage base band controller chip to interface to a higher voltage SIM card. The higher voltage bus goes to the SIM card of a mobile phone. The subscriber information module typically contains personal information such as telephone number, identification codes and pin numbers. The circuit of this invention uses active transistor pull-down and pull-up mechanisms. The active pull-up is active for less than one bit time so that the SIM card sees only a 20 kilo ohm resistor allowing performances equal to or better than ISO7816 specifications.

21 Claims, 2 Drawing Sheets

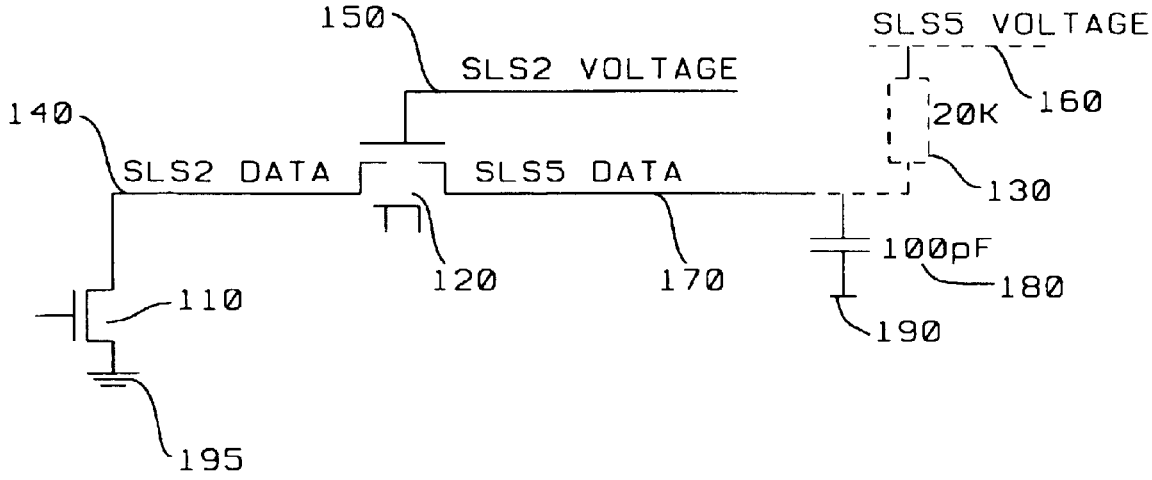
FIG. 1 – Prior Art
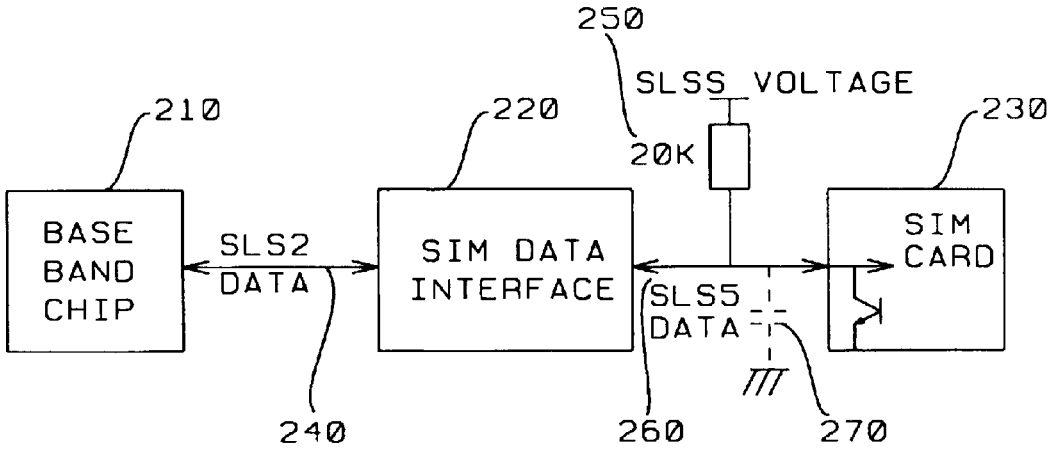
FIG. 2

ACTIVE SUBSCRIBER INFORMATION MODULE

BACKGROUND OF THE INVENTION

1. Field of the Invention

This invention relates to a circuit and a method for interfacing a subscriber information module, SIM to a base band controller for a mobile phone.

More particularly this invention relates to providing voltage level shifting to allow a low voltage base band controller chip to interface to a higher voltage SIM card.

2. Description of Related Art

FIG. 1 shows the traditional method of interfacing a base band controller chip with SLS2 data interface to a subscriber information module (SIM) card with its SLS5 data interface. The SLS5 bus goes to the SIM card of a mobile phone. The subscriber information module typically contains personal information such as telephone number, identification codes and pin numbers. The SIM data interface is simply a voltage level shifter and buffer between two voltage domains such as SLS2 and SLS5. The maximum capacitance on the SLS5 bus is about 100 picofarads. The minimum resistance on the SLS5 bus is 20 kilo ohms. Also, as is seen in FIG. 1, the data communication is bidirectional between the SIM data interface logic and the SLS2 base band controller chip 110. Similarly, the interface between the SIM data interface and the SLS5 SIM card is also bidirectional. The problem is to be able to drive the SLS5 data lines and the SLS2 data lines very quickly despite the 2 usec time constant of the 20 kilo ohm resistor and 100 picofarad capacitance. In FIG. 1, the traditional SIM interface is made up of an NMOS transistor T1 120 whose drain is connected to the SLS2 data lines 140 and whose source is connected to the SLS5 data lines 170. The gate of transistor 120 is connected to the SLS2 voltage 150. The discharge transistor 110 is shown in FIG. 1. Its drain is connected to the SLS2 data line 140. Its source is connected to ground 195. Also, in FIG. 1, there is shown the maximum capacitance of 100 pF 180 on the SLS5 data bus. One end of this capacitor is the SLS5 data bus 170, and the other end is ground 190. The minimum resistance of 20 kilo ohms 130 is shown between the SLS5 voltage 160 and the SLS5 data line 170.

U.S. Pat. No. 6,324,402 (Waugh, et al.) "Integration Scheme for a Mobile Telephone" describes an architecture to integrate wireless and wired telecommunication networks. SIM card and base station controller data interchange are described.

U.S. Pat. No. 6,032,055 (Yazaki, et al.) "Method of Activation of Mobile Station" discloses a method to activate a mobile phone. SIM card access and verification is performed. Interface blocks for the SIM card and base station controller are illustrated.

U.S. Pat. No. 6,157,966 (Montgomery, et al.) "System and Method for an ISO7816 Compliant Smart Card to Become Master over a Terminal" discloses a system and a method for an ISO7816 compliant smart card.

U.S. Pat. No. 6,263,214 (Yazaki, et al.) "Method for Controlling Activation of Mobile Station, and Mobile Station Using the Method" discloses a method for controlling activation of a mobile station having a SIM card.

BRIEF SUMMARY OF THE INVENTION

It is the objective of this invention to provide a circuit and a method for interfacing a subscriber information module, SIM to a base band controller for a mobile phone.

It is further an object of this invention to provide voltage level shifting to allow a low voltage base band controller chip to interface to a higher voltage SIM card.

The objects of this invention are achieved by a circuit which a subscriber information module data interface circuit made up of a bidirectional interface to SLS2 data from a baseband controller semiconductor chip and a bidirectional interface to SLS5 data going to a subscriber information card. The circuit contains a primary input sls2_ip and a primary output sls2 which make up the bidirectional interface to SLS2 data from the base band controller. In addition, the circuit contains a primary input sls5_ip and a primary output sls5 which make up the bidirectional interface to SLS5 data from the SIM, subscriber information module.

BRIEF DESCRIPTION OF THE DRAWINGS

FIG. 1 shows a prior art block diagram of an interface between a base band controller output stage and the input to a SLM, subscriber interface module.

FIG. 2 gives a block diagram of the high level embodiment of this invention.

DETAILED DESCRIPTION OF THE INVENTION

Figure 3:
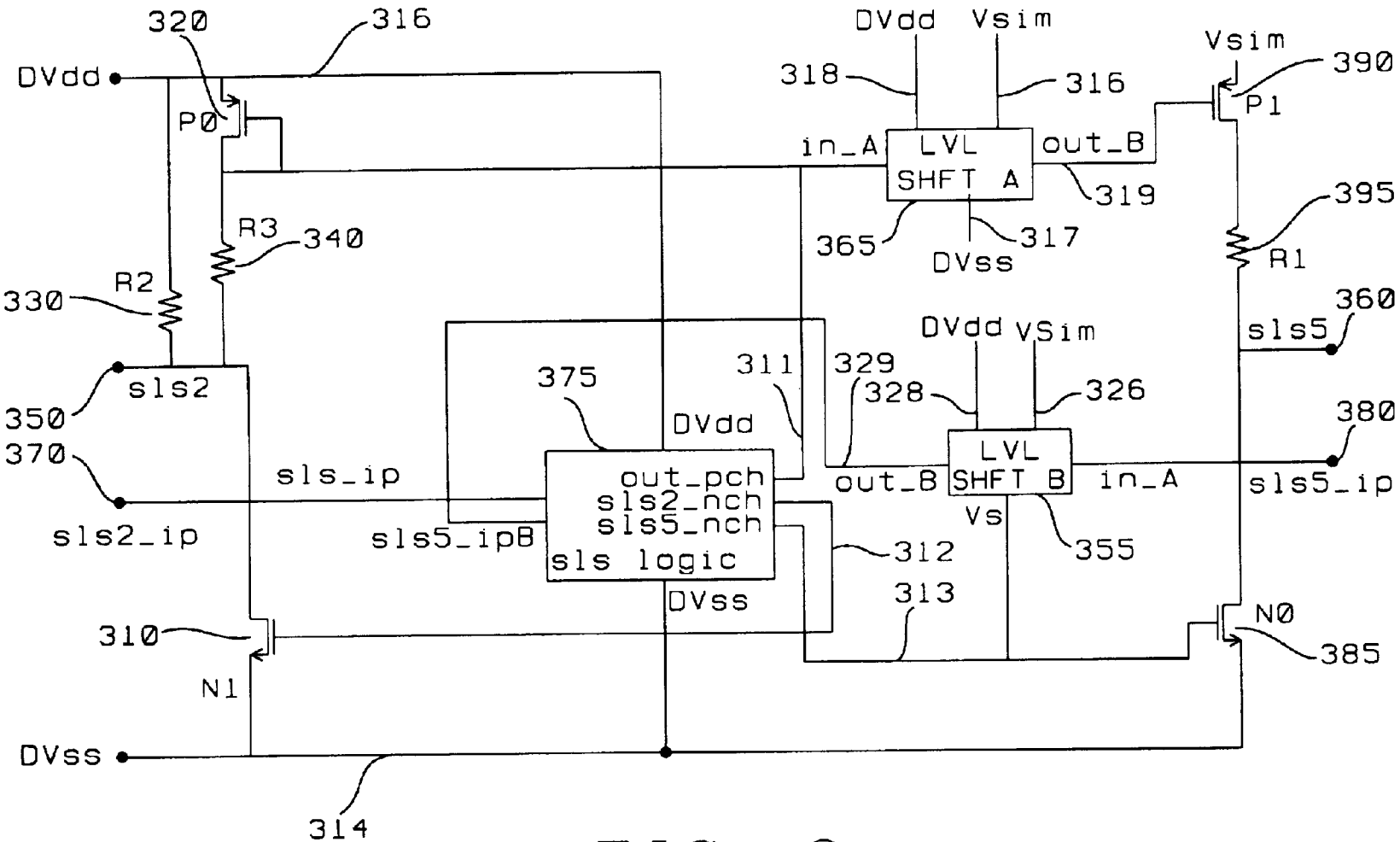
FIG. 3 shows a detailed circuit embodiment of the SLM interface of this invention

FIG. 2 shows a block diagram of this invention. The SIM, subscriber information module data interface 220 is the block of the invention. The base band controller chip 210 drives the bidirectional SLS2 data bus 240, which goes into the SIM module 220. The other SIM interface 260 drives the SIM card. A pull-up 20 kilo ohm resistor 250 is connected between the SLS5 data bus and the SLS5 voltage power supply. The typical 100 picofarad capacitance 270 of the bus is shown in FIG. 2. The purpose of the SIM data interface 220 is to provide voltage level shifting to allow the low voltage base band controller chip 210 to interface to the high voltage SIM card 230.

FIG. 3 shows the detailed circuit embodiment of this invention. The bidirectional data interface to the SLS2 data bus, includes an output sls2 350 and an input sls2_ip. The sls2_ip primary input 370 goes into the sls_logic block 375. The sls2 primary output 350 comes from the drain of the NMOS FET 'A' 310. The source of the NMOS FET 310 is connected to Vss 314.

FIG. 3 also shows PMOS FET 'A' whose drain is connected to a 4 kilo ohm resistor 'A'. The other end of the resistor 'A' 340 is connected to the drain of said NMOS FET 'A' which is the primary output sls2 350. The value of the 4K resistor 'A' could be different, 3K for example. The actual values chosen are implementation dependent.

This sls2 output node 350 is also connected to a 20 kilo ohm resistor 'B'. The other end of resistor 'B' is connected to Vdd 316.

In FIG. 3, the bidirectional data interface to the sls5 data bus includes a primary output, sls5 360 and a primary input, sls5_ip. The sls5_ip primary input 380 goes into the level shift logic block 355. The sls5 primary output 360 comes from the drain of NMOS FET 'B' 385. The source of this NMOS FET 385 is attached to Vss 314. The gates of the NMOS FET 'B' comes from the sls5_nch 313 signal out of the sls_logic block 375. The node of the primary output sls5 360 is also connected to one end of a 4 kilo ohm resistor 395. The other end of the 4 kilo ohm resistor 'B' 395 is attached to the drain of PMOS FET 'B' 390. The gate of PMOS FET 390 comes from the out_B 319 signal from the voltage level shift block A 365.

Voltage level shift block A 365 has an in_A input which comes from the sls_logic block 375 output out_pch 311. Both the lower voltage power supply voltage, Vdd, 318 and the higher voltage power supply, Vslm, 316 go into the voltage level shift block A 365. In addition, the Vss voltage 317 goes into the voltage level shift block A 365.

Voltage level shift block B 355 has an in_A input which comes from the primary input sls5_ip 380. Both the lower voltage power supply voltage, Vdd, 328 and the higher voltage power supply, Vslm, 326 go into the voltage level shift block B 355. In addition, the Vss voltage 314 goes into the voltage level shift block B 355. The out_B 329 signal from the voltage level shift block B 355 goes into the sls_logic block 375.

The sls_logic block 375 has an input coming from primary input sls2_ip. The block 375 also has an input, sls5_ip_B coming the voltage level shift block B 355. The sls_logic block 375 provides three outputs. The out_pch 311 goes to the voltage level shift block A and to the gate of PMOS FET 'A' 320. The output sls2_nch 312 goes to the gate of NMOS FET 'A'. The output sls5_nch 313 goes to the gate of NMOS FET 'B' 385. The power supply voltage, Vdd, 316 and the Vss voltage 314 goes into the sls_logic block 375.

The advantage of this invention is that the use of an active transistor pull-up which is active for less than one bit time so that the SIM card sees only a 20 kilo ohm resistor as specified. The SIM interface circuit of this invention allows a performance that is equal to or better than the specified ISO7816 performance requirements.

While this invention has been particularly shown and described with Reference to the preferred embodiments thereof, it will be understood by those Skilled in the art that various changes in form and details may be made without Departing from the spirit and scope of this invention.

What is claimed is:

1. A subscriber information module data interface circuit comprising:

a bidirectional interface to low voltage data from a baseband controller semiconductor chip, a bidirectional interface to higher voltage data going to a subscriber information card, a primary input with lower voltage and a primary output with lower voltage which make up said bidirectional interface to low voltage data from said base band controller, and a primary input with higher voltage and a primary output with higher voltage which make up said bidirectional interface to high voltage data from said SIM, subscriber information module.

2. The circuit of claim 1 further comprising:

An NMOS FET 'A' whose source is connected to Vss, whose drain is connected to SLS2 and whose gate is connected to the SLS5_NCH output from an SLS_logic block.

3. The circuit of claim 1 further comprising:

A PMOS FET 'A' whose drain is connected to 4 kilo ohm resistor A, whose source is connected to Vdd, and whose gate is connected to a signal, out_pch, which is a precharge signal from an SLS logic block.

4. The circuit of claim 1 further comprising:

an NMOS FET 'B' whose drain is connected the SLS5 data output, whose source is connected to Vss or ground, and whose gate is connected to the sls5_nch precharge signal from an sls_logic block.

5. The circuit of claim 1 further comprising:

a PMOS FET 'B' whose drain is connected to 4 kilo ohm resistor A, whose source is connected to Vdd, and whose gate is connected to a signal out_B, which is a control signal from a voltage level shift logic block A.

6. The circuit of claim 1 further comprising:

an sls_logic block whose inputs consist of sls2_ip and sls5_ip_A and whose outputs consist of out_pch, sls2_nch, and sls5_nch.

7. The circuit of claim 6 wherein input sls5_ip_A comes from a voltage level shift logic block B.

8. The circuit of claim 6 wherein input sls2_ip is a primary input into said circuit from the SLS2 data which comes from a base band controller chip.

9. The circuit of claim 6 wherein output out_pch goes to both a voltage level shift logic block A and to the gate of said PMOS FET 'A'.

10. The circuit of claim 6 wherein output sls5_nch goes to the gate of said NMOS FET 'B'.

11. The circuit of claim 6 wherein output sls2_nch goes to the gate of said NMOS FET 'A'.

12. The circuit of claim 1 further comprising:

a voltage level shift logic block 'A' whose inputs consist of sls5_ip, Vsim and Vdd, and whose outputs consist of sls5_ip_A.

13. The circuit of claim 12 wherein input sls5_ip is a primary input to said circuit which comes from a subscriber information module circuit.

14. The circuit of claim 12 wherein input Vsim is a primary input and is the voltage level of said SIM, subscriber information module.

15. The circuit of claim 12 wherein input Vdd is a primary input and is the voltage level of said base band controller chip.

16. The circuit of claim 12 wherein output sls5_ip_A is a level shifted voltage which goes to the input of said sls_logic block.

17. The circuit of claim 1 wherein a 4 kilo ohm resistor 'A' is connected between the drains of said PMOS FET 'A' and said NMOS FET 'A'.

18. The circuit of claim 1 wherein a 20 kilo ohm resistor 'B' has one end connected to the supply voltage, Vdd and another end connected to said 4 kilo ohm resistor 'A' forming a node which is said sls2 primary output voltage which interfaces to said base band controller chip.

19. The circuit of claim 1 wherein a 4 kilo ohm resistor 'c' has one end connected to the drain of said PMOS FET 'B' and its other end connected to the drain of said NMOS FET 'B' forming said primary output sls5 which is said interface to the SIM, subscriber information module.

20. The circuit of claim 1 wherein PMOS FET 'B' is turned 'ON' for only a short time, 't', long enough to produce a high level at node sls5, but short enough so that it is less than one bit time.

21. A method of connecting a base band controller chip to a subscriber information module comprising the step of:

shifting the voltage levels from the lower voltage level of the base band controller to the higher voltage level required by the SIM, subscriber information module, wherein the voltage level shifting is performed using logic blocks with the two different supply voltages, Vdd and Vslm.

* * * * *